US005381846A

United States Patent [19]

Lichy

[11] Patent Number: 5,381,846

[45] Date of Patent: Jan. 17, 1995

[54] SIDE COILING FABRIC DOOR

[76] Inventor: Dale M. Lichy, 214 Royal Daulton Ct., Gibsonia, Pa. 15044

[21] Appl. No.: 60,064

[22] Filed: May 13, 1993

[51] Int. Cl.[6] ..... E06B 9/56

[52] U.S. Cl. ..... 160/273.1; 160/133; 160/321

[58] Field of Search ..... 160/271, 273.1, 133, 160/265, 264, 270, 310, 323.1, DIG. 8, DIG. 10, 319, 321

[56] References Cited

U.S. PATENT DOCUMENTS

| | | | |
|---|---|---|---|
| 1,216,794 | 2/1917 | Garmen | 160/DIG. 10 |
| 1,621,717 | 3/1927 | Grant et al. | 160/133 |
| 1,857,673 | 5/1932 | Vallen | 160/122 X |
| 2,019,084 | 10/1935 | Miller | 160/319 X |
| 2,934,139 | 4/1960 | Wardlaw et al. | 160/26 |
| 3,092,170 | 6/1963 | Ellis | 160/133 X |
| 3,357,480 | 12/1967 | Matsumoto | 160/133 |
| 3,386,489 | 6/1968 | Denton et al. | 160/25 |
| 3,680,622 | 8/1972 | Lester, Jr. | 160/25 |
| 4,096,902 | 6/1978 | Junod | 160/122 |
| 4,864,783 | 9/1989 | Esposito | 160/273.1 X |
| 4,874,026 | 10/1989 | Worrall | 160/23.1 |
| 4,884,617 | 12/1989 | Coenraets | 160/271 |
| 4,993,468 | 2/1991 | Hackman et al. | 160/273.1 X |
| 5,131,450 | 7/1992 | Lichy | 160/310 |
| 5,163,495 | 11/1992 | Lichy | 160/273.1 |

*Primary Examiner*—Blair M. Johnson

*Attorney, Agent, or Firm*—Jacobson, Price, Holman & Stern

[57] ABSTRACT

The invention relates to closures for doorways or other similar access openings and more specifically to side coiling doors in which the closure curtain forming the door is a flexible, fabric like material that is wrapped onto or coiled onto and unwrapped from or uncoiled from a vertically disposed, rotatably supported, relatively short barrel with only the upper edge portion of the door being engaged by and supported by the barrel. The upper edge of the flexible curtain forming the door is maintained on the barrel by the use of a unique spring tensioning assembly engaged with the barrel and an interlocking tracking member between the barrel and convolutions of the flexible curtain. The upper edge of the flexible curtain forming the door is supported, guided and moved along the upper edge of the opening by a track and cable system that is associated with the door opening and vertical barrel to enable effective opening and closing movement of the side coiling doors.

20 Claims, 5 Drawing Sheets

SIDE COILING FABRIC DOOR

BACKGROUND OF THE INVENTION

1. Field of the Invention

The present invention generally relates to closures for doorways or other similar access openings and more specifically to side coiling doors in which the closure panel forming the door is a flexible, fabric like material that is wrapped onto or coiled onto and unwrapped from or uncoiled from a vertically disposed, rotatably supported, relatively short barrel with only the upper edge portion of the door being engaged by and supported by the barrel. The upper tracking edge of the flexible material forming the door is maintained in alignment on the barrel by the use of a unique spring tensioning assembly engaged with the barrel and an interlocking tracking means between the barrel and convolutions of the flexible material. The upper edge of the flexible material forming the door is supported, guided and moved along the upper edge of the opening by a tracking system that is associated with the door opening and vertical barrel to enable effective opening and closing movement of the side coiling doors. The lower edge of the flexible material forming the door is guided by a recessed track having an upwardly facing slot receiving the hemmed lower edge of the flexible material that is provided with a flexible rope or cable received in the hem along the bottom edge of the flexible door or curtain with rollers or wheels at the leading bottom corner of the flexible curtain or door which prevents the curtain from blowing outwardly or otherwise being forced out of the opening when in closed position.

2. Description of the Prior Art

In various commercial and industrial facilities, it is frequently desirable or necessary to close an opening through a wall to separate and protect one area from environmental conditions that may exist in an adjacent area. The openings are necessary for the purpose of allowing movement of traffic, either vehicular or pedestrian to pass through the opening when moving from one area to another. If the opening is in an interior wall or, in some instances, if the opening is in an exterior wall or opening, it is not necessary to utilize a security type door. One problem which exists with vehicular traffic is the occasional striking of the closure door by the vehicle due to vehicle operator error and other causes.

Various efforts have been made to provide closure doors for such openings by providing overhead doors which roll up or down vertically and side coiling doors that open horizontally. Prior art doors usually include some type of guide structure or track structure for guiding and supporting the flexible doors as they move between open and closed positions. Any structure that is oriented along the vertical side edges of the door opening is subject to contact and possible damage by vehicular traffic. The following U.S. Pat. Nos. are exemplary of the developments in this field of endeavor.

2,934,139
3,386,489
3,680,622
4,096,902
4,874,026
5,131,450
5,163,495

While the prior art discloses side coiling doors wrapped on a vertical barrel placed along one or both sides of an opening, such barrel or barrels are of a length substantially equal to the height of the opening. With this type of structure, the barrels are subject to damage due to vehicular impact. The present invention provides a structure that enables the flexible door member to be moved between open and closed positions with only the upper edge portion thereof supported by a vertical barrel thereby eliminating damage which occurs to previously used vertically elongated barrels by impact from vehicles with any impacts to the flexible closure member below the relatively short vertical barrel used in the present invention resulting in little or no damage to the door.

SUMMARY OF THE INVENTION

An object of the present invention is to provide a side coiling flexible door moveable between open and closed positions with short vertical barrels at one or both sides of the opening engaging only the upper edge portion of the flexible door with the barrels being suspended from the top of the opening and projecting only a short distance down the side of the door jamb with the remainder of the flexible door being suspended in a manner that impact of a vehicle will cause little or no damage to the suspended flexible coiled door.

Another object of the invention is to provide a side coiling flexible door as set forth in the preceding object in which the short barrels will form the flexible material in a cylindrical or barrel-like shape but, in fact, no structural barrel is provided in the interior of the coiled flexible door except for a relatively short upper end portion thereby avoiding damage to the suspended barrelless coil in the event it is struck by a vehicle passing through the opening.

A further object of the invention is to provide a side coiling flexible door as set forth in the preceding objects utilizing a unique spring tensioned structure between the barrel or barrels and a power shaft with the spring tension being applied to the barrel and thus to the flexible material by a substantially constant force as the flexible door material wraps onto or unwraps from the barrel with the spring tension applied being varied as the barrel rotates thus maintaining substantially constant spring tension on the flexible door material at all times when winding onto or unwinding from the barrel.

Still another object of the invention is to provide a side coiling flexible door in which the flexible material is provided with an interlocking tracking member fastened to the top edge portion of the curtain or flexible material which in conjunction with the spring tension on the barrel keeps the flexible material or curtain from falling off the barrel with the tracking material also insuring proper alignment of the tracking material into the guide or track which extends across the top edge of the opening thereby eliminating the use of rollers or wheels along the top and/or bottom edge of the flexible door.

A still further object of the invention is to provide a side coiling flexible door in accordance with the preceding objects in which the bottom edge of the flexible door is guided by a recessed track in the form of a tubular member having an upwardly opening slot receiving the bottom edge of the flexible door that is provided with the flexible rope or cable which enables the bottom edge of the door to be side coiled with rollers or wheels being provided at the bottom corners of the leading edges of the flexible doors or curtains.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
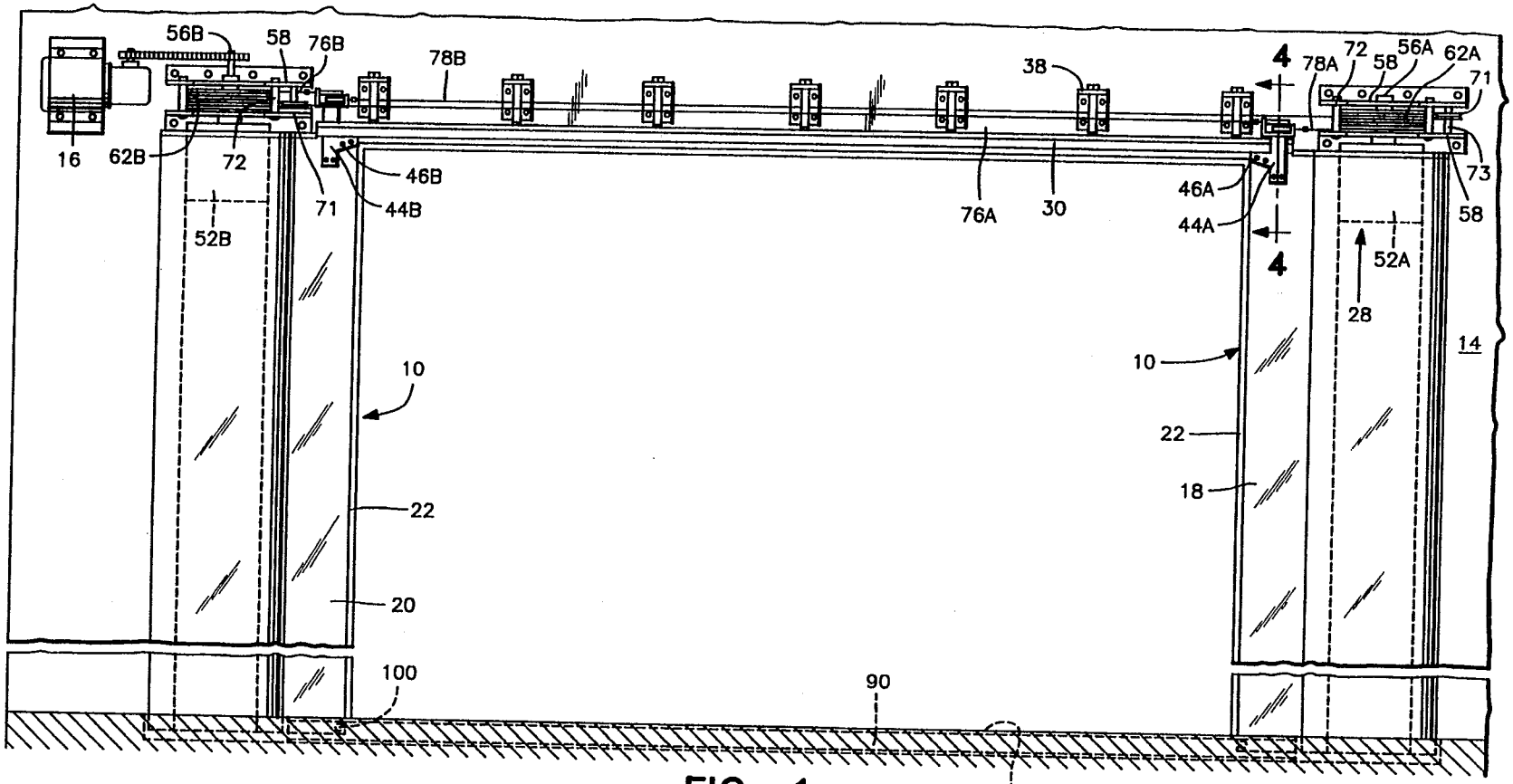
FIG. 1 is a front elevational view of a dual slide side coiling flexible door in open position.
Figure 2:
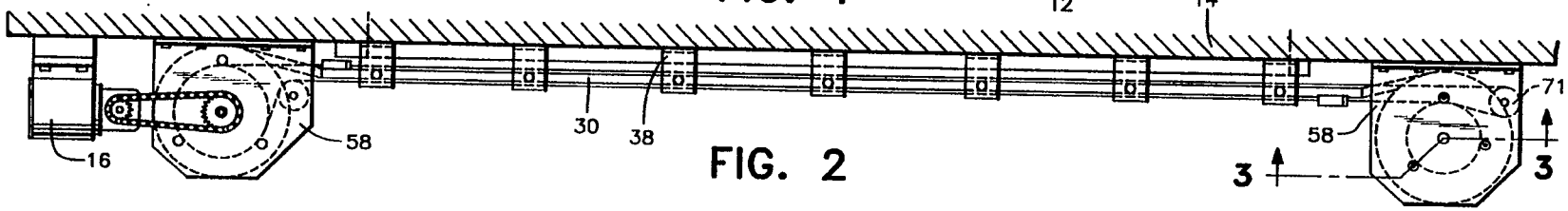
FIG. 2 is a top plan view thereof.

Referring now specifically to FIGS. 1-12 of the drawings, the side coiling flexible door of the present invention is generally designated by reference numeral 10 and is illustrated in association with an opening 12 in a building wall 14 which may be an interior partition wall or an exterior wall with the side coiling door of the present invention being illustrated in open position in FIG. 1 to enable pedestrian traffic or vehicular traffic to move through the opening 12. The side coiling door is moved between open and closed positions by a motor 16 or by any other power mechanism including a hand crank or the like. If a motor is used, various automatic controls may be provided for automatically opening and closing the door or a manual switch may be provided for opening and closing the door.

As illustrated, a dual slide coiling door arrangement is provided in which the flexible door includes a flexible closure element or curtain at each side thereof indicated by reference numerals 18 and 20 with the free edge of the curtain including a substantially rigid jamb member 22 which contact each other when the flexible curtains 18 and 20 are in their closed position. When jamb members 22 are not used or are not rigid, the edges of curtains 18 and 20 may overlap each other by 6 inches to 24 inches. The curtains 18 and 20 are constructed of a flexible material, preferably a fabric like material such as clear polyvinylchloride or vinyl covered polyester fabric. Attached to the top edge of each of the flexible curtains 18 and 20 is an interlocking tracking member 24A and 24B and an overhead guide track 26 is supported from the top edge of the opening 12 to support the flexible curtains 18 and 20 for sliding movement as described hereafter.

At each side of the opening, a vertical barrel assembly 28 is supported and driven with the barrel assemblies winding the curtains 18 and 20 onto barrels 52A and 52B and enabling them to unwind from the barrels. As illustrated, the barrels are relatively short as compared to the vertical height of the opening and curtains 18 and 20 with the length of the barrels 52A and 52B being not more than approximately 14 inches even when the total door height may be 30 feet or more. The barrels form each flexible curtain into a barrel like shape but, in fact, there is no structural barrel on the interior of the convolutions of the flexible door curtains below the bottom edge of the barrels thereby eliminating damage to the side coiling door in the event a vehicle strikes the door curtains when they are wound onto the short barrels at the side edges of the opening.

Figure 3:
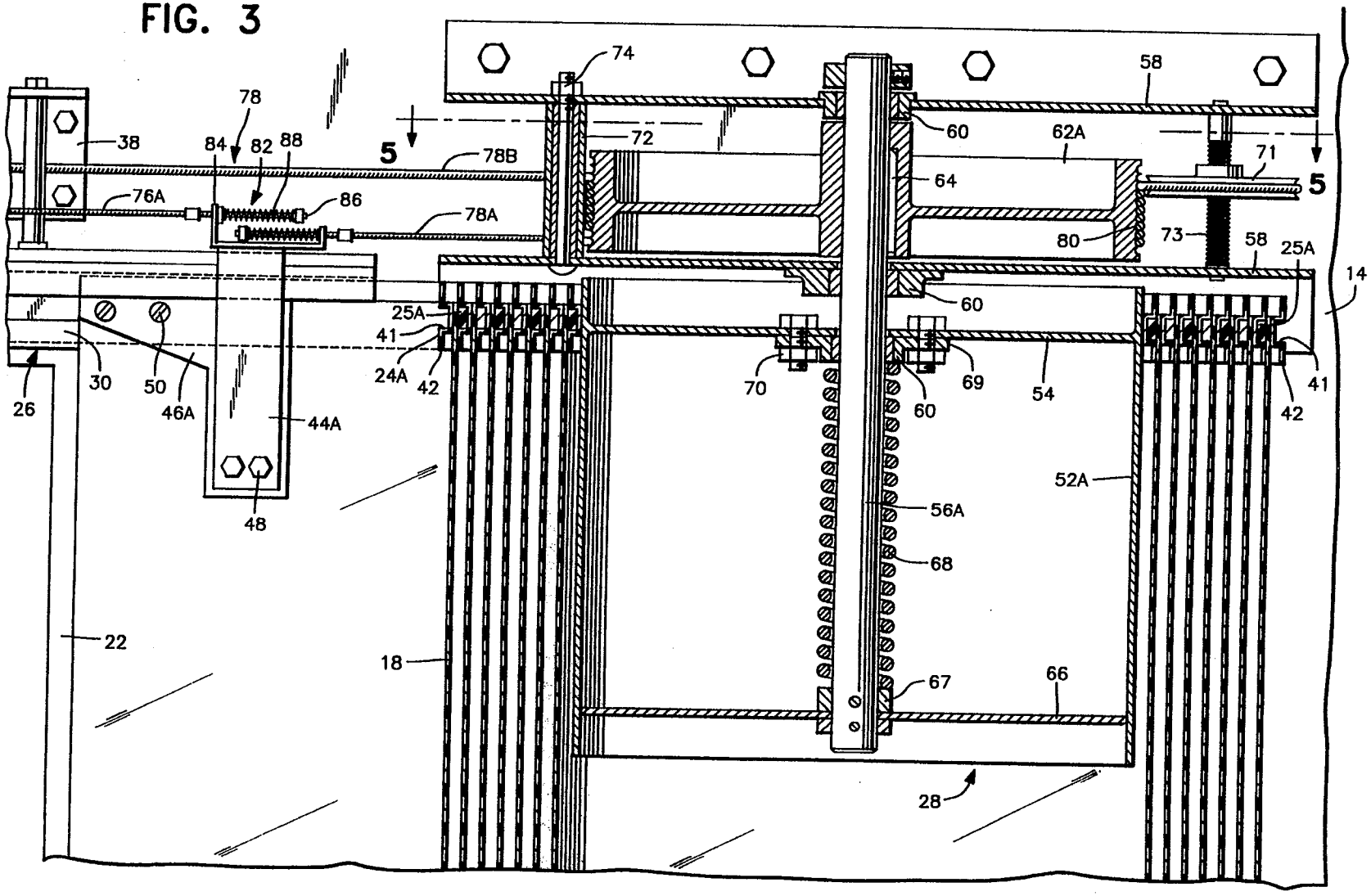
FIG. 3 is an enlarged vertical sectional view taken along section line 3—3 on FIG. 2 illustrating details of the short vertical barrel and spring tensioned arrangement.
Figure 5:
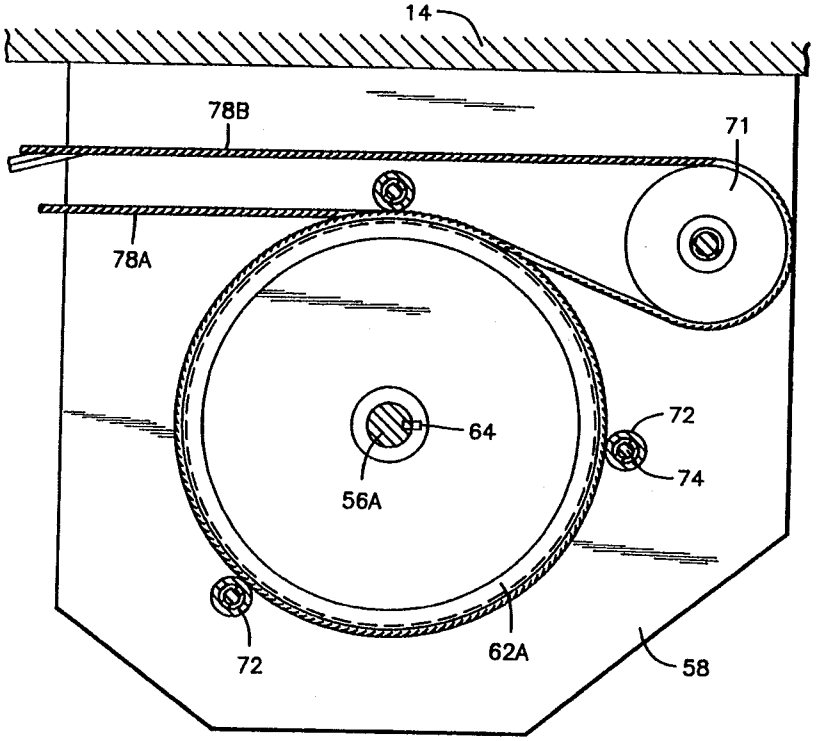
FIG. 5 is a sectional view taken along section line 5—5 on FIG. 3 illustrating further details of the cable and drum arrangement.
Figure 4:
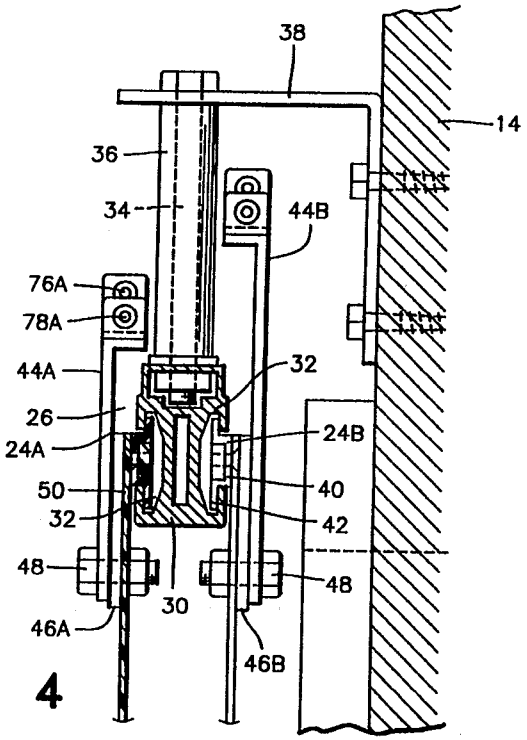
FIG. 4 is a vertical sectional view taken along section line 4—4 on FIG. 1 illustrating the structural details of the supporting and guiding track.

The track assembly 26 includes an elongated track member 30 in the form of an aluminum extrusion or the like provided with laterally opening channel shaped trackways 32 facing inwardly and outwardly. The top edge of the track is supported by a bolt 34 and spacer 36 from a suitable overhead support 38 as illustrated in FIG. 4. The interlocking tracking members 24A and 24B at the upper edge of each of the door panels is of generally hat shaped transverse configuration which includes a central offset vertical bight portion 40 and top and bottom offset flanges 42 which are received in the trackways 32 with the bight portion 40 extending outwardly of the trackway 32 and being secured to a surface of the upper edge of a door curtain by stitching or other fastening arrangements such as by heat sealing and the like inasmuch as the material from which the interlocking tracking members 24A and 24B may also be a thermo-plastic material. The upper leading edge portion of each of the curtains 18 and 20 is provided with a cable plate 44A and 44B, respectively, which extend above the track 30 for connection with actuating cables in a manner described hereinafter. The plates 44A and 44B are attached to curtain plates 46A and 46B, respectively, by fastening bolts 48 or the like at the lower end thereof and plates 46A and 46B are attached to the upper edge of the door curtains 18 and 20, respectively, and interlocking tracking members 24A and 24B by flat head screws 50 or equivalent fastening arrangements as illustrated in FIGS. 3 and 4. As illustrated in FIG. 4, the plate 44A disposed outwardly of the track 30 extends to a shorter height than the plate 44B outwardly of the track for connection with a cable drive arrangement as set forth hereinafter.

Figure 10:
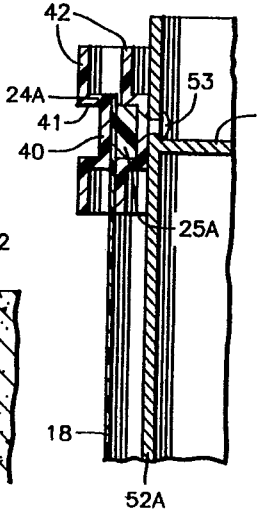
FIG. 10 is an enlarged fragmental sectional view of the upper end portion of the vertical barrel at the right side of the door illustrating the first convolution of the tracking member rigidly affixed thereto and the first convolution of the door.

As illustrated in FIG. 3, the upper edge of the flexible curtain 18 includes a continuous projection 25A on the surface thereof which faces outwardly of the track 30 but which faces inwardly towards the barrel 52A when wound thereon. As illustrated in FIGS. 3 and 10, the barrel 52A is cylindrical with the first convolution of the tracking member 24A being rigidly affixed thereto as by rivets 53 or other suitable fastening means with no curtain 18 being mounted on the first convolution of tracking member 24A that is secured to barrel 52A. The flanges 42 of the tracking member 24A are spaced from the periphery of the barrel 52A and the offset bight portion 40 is fixed to the barrel 52A. An outwardly facing groove 41 formed by the bight portion 40 will then receive the projection 25 in the first convolution of the flexible curtain 18 wound onto barrel 52A thus providing a vertical support for subsequent convolutions of the flexible curtain 18 inasmuch as the projection 25 in each convolution is received in the groove 41 of the preceding convolution when the curtain 18 is wound in a spiral manner onto the cylindrical barrel 52A thereby providing an interlocking supporting connection between each convolution of the curtain 18 and the barrel 52A.

Figure 11:
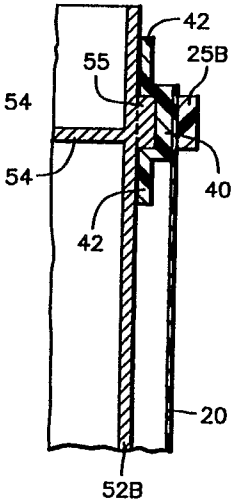
FIG. 11 is an enlarged fragmental sectional view of the left side barrel with a ring rigid thereon and the first convolution of the curtain.

As shown in FIG. 11, the barrel 52B at the left side of the opening 12 has a rigid ring 55 fixed thereto which is engaged by and is received in the groove 41 on the tracking member 24B mounted on the upper edge of curtain 20. The tracking member 24B attached to curtain 20 has flanges 42 received in the inner trackway 32 as illustrated in FIG. 4 with the bight portion 40 extending laterally from the trackway 32 with the curtain 20 connected with the bight portion 40. The upper edge of the curtain 20 includes a continuous projection 25B on the surface of the curtain 20 opposite to the bight portion 40 as illustrated in FIG. 11. Therefore, the arrangement of the tracking members 24A and 24B and projections 25A and 25B with respect to the curtains 18 and 20 and barrels 52A and 52B are oppositely arranged and the barrels 52A and 52B are driven in opposite rotational directions when the curtains are being coiled thereon or uncoiled therefrom.

The cylindrical barrels 52A and 52B on which the door curtains are wound or unwound includes a support plate 54 rigid therewith adjacent the upper end. Support and drive shafts 56A and 56B for the barrels 52A and 54B are supported by spaced support plates 58 supported from walls 14 and bearing 60. Shafts 56A and 56B each has a cable drum 62A and 62B, respectively, keyed thereto by a drive key 64. Each cylindrical barrel includes a bottom plate 66 rotatable with respect to the barrel and provided with a casting 67. The casting 67 is pinned to shaft 56A or 56B which is drivingly connected to the respective barrels 52A and 52B through a tension coil spring 68 of cylindrical configuration as illustrated in FIG. 3. The lower end of spring 68 is threaded over and connected to casting 67 and thus connected to the lower end of shaft 56A or 56B. The upper end of spring 68 is fixedly connected to casting 69 fastened to support plate 54 by bolts 70 thereby connecting shafts 56A and 56B to barrels 52A and 52B through spring 68.

The cable drums 62A and 62B are associated with an internally threaded cable sheave 71 mounted on an externally threaded support shaft 73 stationarily mounted between support plates 58. The sheaves 71 aligns a front cable 76 or a rear cable 78 as they wrap onto cable drums 62A and 62B. The cable sheaves 71 move up or down at near the exact speed as required by the cable drum grooves 80 on the cable drums 62A and 62B. Rollers 72 are each journaled on a support shaft or rod 74 extending between the support plates 58 for retaining the front cable 76 and the rear cable 78 engaged with the cable drums 62A and 62B during installation or maintenance of the door.

As the barrel 52A rotates in a clockwise direction, door curtain 18 is wrapped thereon as it moves toward open position and the tracking member 24A being attached to the door curtain 18 will wrap onto barrel 52A with the number of convolutions thereon being dependent upon the diameter of the barrel and the horizontal length of the door curtain. As each wrap or convolution is applied to the barrel 52A, the projection 25A interlocks with the previously wrapped or wound tracking member 24A as illustrated in FIG. 3. This interlocking function operates in conjunction with the spring tension which remains substantially constant to hold the door curtain and the tracking member in alignment for ingress into and egress from the trackway 32. The use of the interlocking tracking members 24A and 24B fastened to the top of the door curtain in conjunction with the spring tension serves to retain the door curtain from falling off of the barrels as well as insuring proper alignment of the tracking members 24A and 24B into the trackways 32. The tracking members 24A and 24B and projections 25A and 25B are constructed of UHMW plastic that is fastened to the top of the door curtains 18 and 20 is sufficiently flexible to enable it to wrap onto the barrel 52A and 52B along with the flexible door curtains 18 and 20. The leading edge of the tracking members 24A and 24B attached to the plates 46A and 46B always remain in the guide trackways 32 for at least 4 inches even in the open position.

During installation, a pretension is applied to the barrels 52A and 52B by turning the barrels around the shafts 56A and 56B while the cable drums 62A and 62B remain stationary. When this pretension is applied to the barrels, one at a time, the cables 76 and 78 are anchored to the plates 44A and 44B to hold the tension constant. As the door curtains 18 and 20 unwrap from the barrels by a pulling force from plate 46, it causes rotation of the shaft 56A.

Since the cable drum 62 is similar in diameter to the barrel 52 the almost identical turns of the shaft, barrel and cable drum will cause very insignificant additional or lesser tension on the tension spring 68. The procedure for spring tensioning has several major benefits since it will increase the life span of the spring by reducing the cyclic tensioning and loosening thereof. This also allows a constant spring pressure to be maintained when coiling and uncoiling the flexible curtains and it allows for a slight additional or lesser adjustment tension to be added or subtracted to a slightly varying circumference of flexible material.

As illustrated in FIG. 3, the tension spring 68 is slid over the shaft 56A with one end being threaded to casting 67 which in turn is pinned to shaft 56A. The other end of the spring 68 is fixed to the casting 69 and plate 54 at the top of the barrel 52 which are rotatable and supported by bearing 60. Thus, the shaft 56A is connected to the cable drum 62 so that when the cable drum turns or the shaft turns, both will turn approximately an equal number of turns. The spring tension arrangement works in conjunction with the tracking member 24 and projection 24A to maintain the flexible curtain from falling off the barrel with the spring tension producing a substantially constant force as the flexible curtain wraps or unwraps in relation to the barrel 52. As the cable is wrapping or unwrapping from or onto the cable drum, it causes the spring tension to adjust to the barrel turns.

Figure 6:
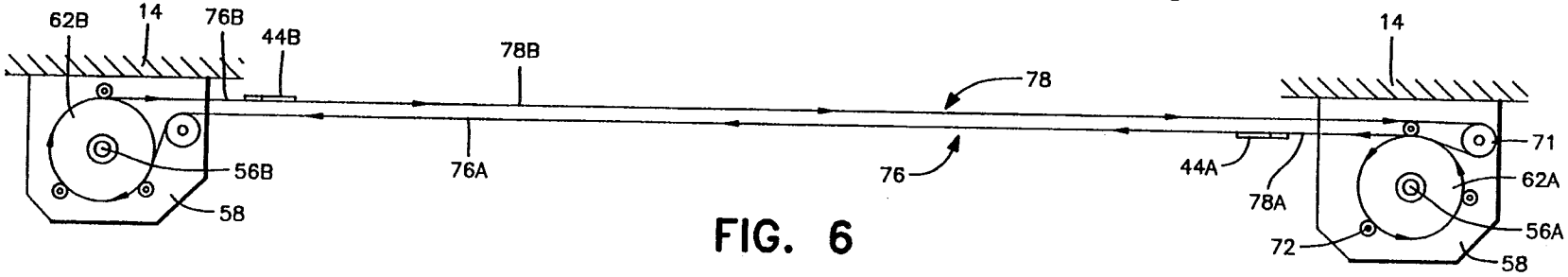
FIG. 6 is a schematic plan view illustrating the cable path in a dual slide arrangement.

On the double slide or double barrel arrangement as illustrated in FIGS. 1–12, the cables 76 and 78 may be considered two cable segments 76A and 76B and 78A and 78B wound on the cable drums 62 at the opposite sides of the door opening 12 and the end of each A cable segment being connected to plate 44A and each B cable segment being connected to the rear plate 44B. FIGS. 1 and 6 illustrate the structure in which the plates 44A and 44B are in their open position and the curtains 18 and 20 are in their open position. When the shaft 56B is driven in a clockwise direction by a motor, the cable segment 76A is wound onto drum 62B connected to shaft 56B to pull plate 44A toward closed position and the cable segment 76B that is connected to plate 44B is wound off of the drum 62B connected with shaft 56B as observed in FIG. 6. Likewise, movement of cable segment 76A and movement of plate 44A toward closed position will tension cable segment 78A and unwind it from cable drum 62A connected to shaft 56A thus rotating the cable drum 62A in a counterclockwise direction thus winding cable segment 78B onto drum 62A and pulling the plate 44B toward closed position and at the same time tensioning cable 76B so that it is unwound from the cable drum 62B connected to the shaft 56B. By pretensioning the springs within the barrels and anchoring the cable segments to the plates 44A and 44B under such pretension, movement of the plates and cable segments will be synchronized and simultaneous with the pretension of the springs within the barrels being maintained, the rotational turns of the barrels being equalized with the increase in diameter of the spiral coil causing a relatively insignificant variation in the pretension on the springs thus maintaining a substantially constant tension on the cables and flexible curtains.

As illustrated in FIG. 3, the cable ends are connected to the plates by a spring tensioned connection 82 which includes a bracket 84 with a slidable rod 86 extending therethrough with a spring 88 interposed between the bracket and a projection on the end of the rod 86 to enable some degree of resilient extension and retraction of the cables in the event the opening and closing movement of the flexible curtains encounters some resistance or obstruction.

As illustrated in FIGS. 1, 7–9 and 12, the lower edge of a flexible curtain is received in a tubular track 90 recessed into a floor surface 92 or positioned above the lower edge of the opening 12 with an entrance slot 94 being provided in the track 90 for receiving the lower edge of the curtain 18 which is provided with a hem 96 therein and a flexible rope or cable 98 within the hem. This structure retains the flexible curtain within the track and maintains the flexible curtain 18 in a taut condition to prevent it from billowing or being blown inwardly or outwardly by wind or differences in air pressure and yet enables the flexible curtain to move expeditiously between open and closed position so that the jamb edges thereof are retained in close association as illustrated in FIG. 1. This bottom tracking feature, while desirable for certain applications, is features as an option to the trackless bottom and therefore no damage door.

Figure 7:
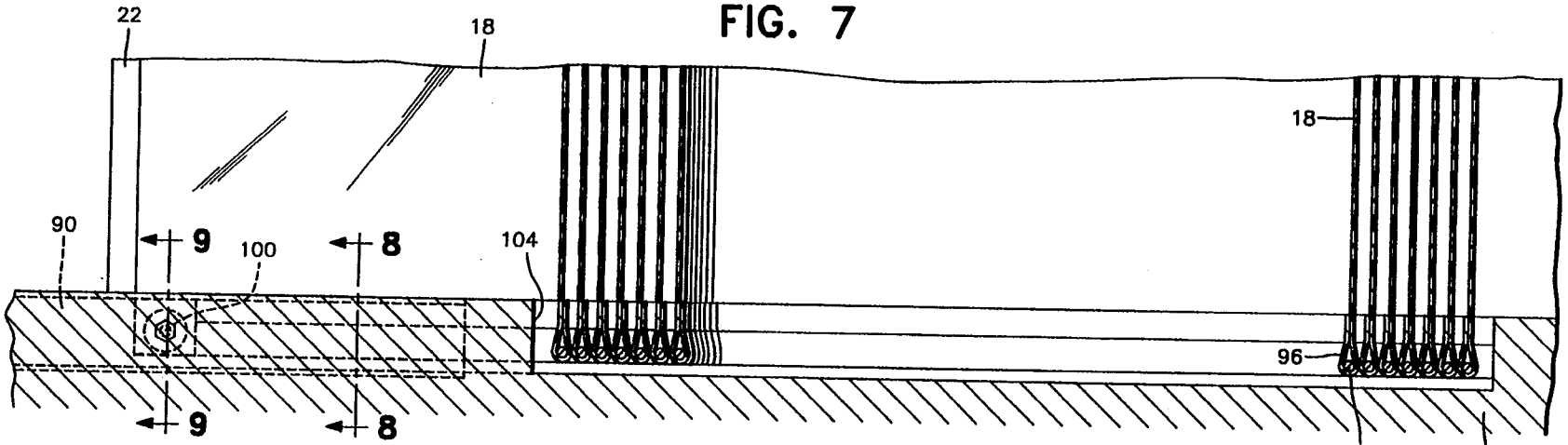
FIG. 7 is a vertical sectional view of the lower end of the side coiling door illustrating the manner in which the lower hemmed edge is coiled and associated with a recessed bottom track.
Figure 12:
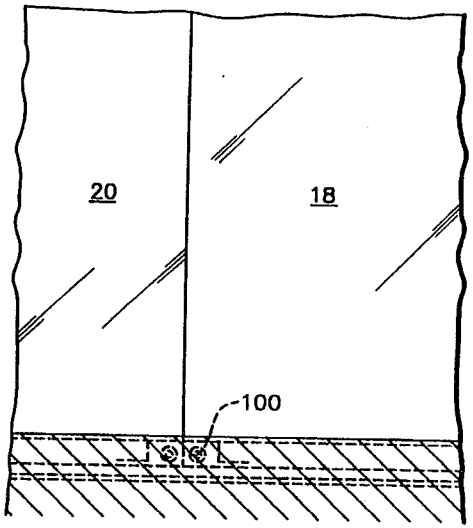
FIG. 12 is a fragmental elevational view illustrating the association of the leading edges of the flexible doors or curtains when in closed position when using a bottom recessed track.
Figure 9:
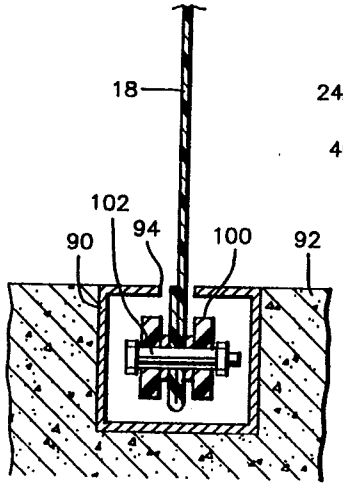
FIG. 9 is a sectional view, on an enlarged scale, taken along section line 9—9 on FIG. 7 illustrating the leading bottom corner edge of the flexible door or curtain with a pair of wheels or rollers mounted thereon to facilitate movement of the lower edge of the door in relation to the track.
Figure 8:
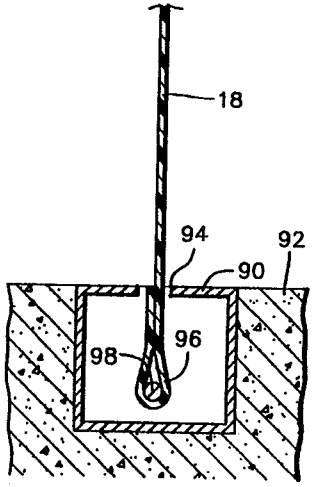
FIG. 8 is a sectional view, on an enlarged scale, taken along section line 8—8 on FIG. 7 illustrating the specific structure of the track and associated bottom edge of the flexible door or curtain.

At the leading edge of the flexible curtain 18 adjacent the jamb 22, the curtain 18 is provided with a pair of wheels or rollers 100 on opposite sides thereof which are rotatably mounted on a shaft or axle 102 oriented within the tubular track 90 as illustrated in FIG. 9 with the two rollers or wheels serving to keep the curtain bottom from hanging up while opening or closing. FIG. 7 illustrates the bottom end of the curtain 18 when coiled into open position with the spirally arranged hem 96 being received in a recess or cavity 104 in the floor generally in alignment with the barrel 52. The bottom tracking and jamb rollers will be used when no vehicle traffic passes through the door opening.

Figure 13:
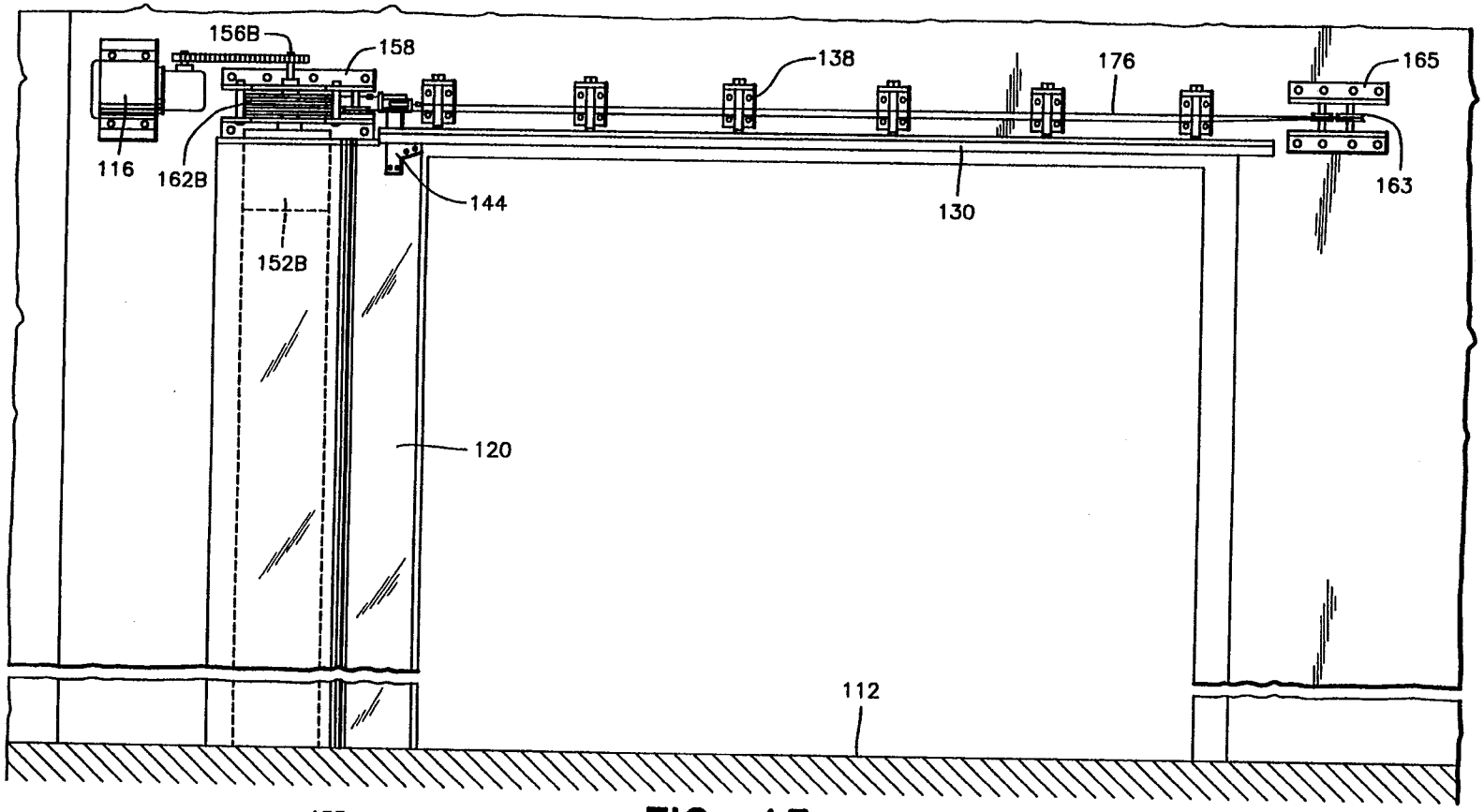
FIG. 13 is a front elevational view of a single slide door.
Figure 14:
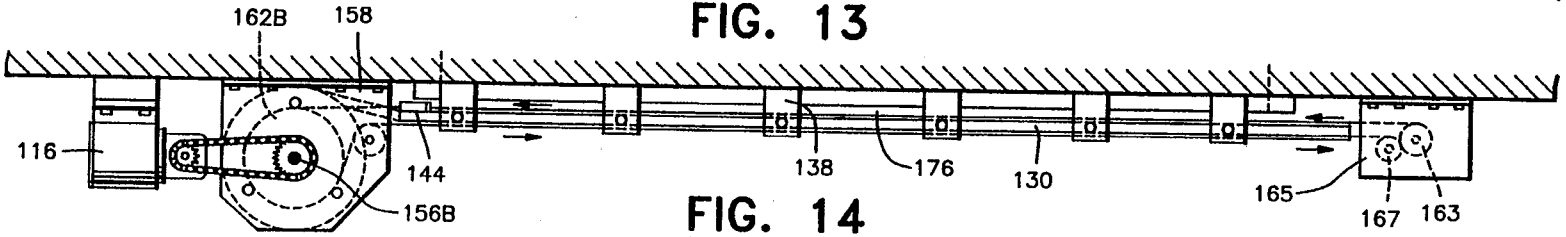
FIG. 14 is a top plan view of the structure of FIG. 13.

FIGS. 13 and 14 disclose a single slide side coiling door in which the structure is substantially the same as the left side of the dual slide door illustrated in FIGS. 1–12 and including a curtain 120 wound onto and off of a short barrel 152B driven from a motor 116 connected to one shaft 156B which rotates a cable drum 162B as well as the barrel with support brackets 158 being provided for this structure. A single support plate 144 is connected with the upper edge of the curtain 120 and is supported from a channel shaped track 130 in the same manner as in FIGS. 1–12. The track 130 is supported by brackets 138 and a cable 176 is wound onto cable drum 162B with the ends of the cable 176 being connected to the plate 144 in the same manner as FIGS. 1–12. At the right hand side of the door opening 112, the cable 176 is entrained around a pulley 163 supported by brackets 165 with an idler pulley 167 maintaining the cable 176 in adjacent relation to the track 130 as illustrated in FIG. 14. The remainder of the structure at the left side of the single slide side coiling door is the same as that in FIGS. 1–12. Operation of the single slide arrangement is substantially the same except that the curtain 120 must move completely across the opening 112. FIGS. 13 and 14 also illustrate the optional arrangement of utilizing a free hanging curtain or curtains not provided with a track in the floor or bottom of the opening.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A side coiling door for an opening comprising a vertically disposed flexible curtain having two opposed faces, means at one edge of the opening for coiling the flexible curtain into a generally vertical coil, track means extending across the opening at an upper edge portion thereof and first means attached to the upper edge portion of one face of the flexible curtain in sliding interlocking connection with the track means, said first means including a recess, second means attached to the upper edge portion of the opposite face of the curtain for supporting the coiled flexible curtain coils with adjacent coils and with the coiling means, said second means comprising a projection sized so as to be accommodated within the recess of the first means when the flexible curtain is coiled.

2. The side coiling door of claim 1 wherein said coiling means comprises a rotatable cylindrical barrel upon which the flexible curtain is coiled and tensioning means for maintaining a substantially constant force as the flexible curtain wraps and unwraps from the cylindrical barrel.

3. The side coiling door of claim 2 wherein said rotatable cylindrical barrel is mounted at one side edge of the opening with its cylindrical major axis vertically disposed and wherein the height of the cylindrical barrel along its major axis is substantially less than the height of the flexible curtain such that the coiled flexible curtain is supported solely by the cylindrical barrel.

4. The side coiling door of claim 3 wherein said cylindrical barrel includes means for engaging one of said first means or second means attached to said flexible curtain.

5. A side coiling door for an opening comprising a vertically disposed flexible curtain, means at an upper portion of the opening to support the curtain for movement between open and closed positions, means at a side edge of the opening for coiling and uncoiling the flexible curtain, said means for coiling and uncoiling including a generally cylindrical, rotatable rigid barrel having a vertical length substantially less than the vertical height of the flexible curtain to engage only the upper edge portion of the flexible curtain with the remainder of the flexible curtain being coiled but free of any engagement with the rigid barrel and hanging freely from said rigid barrel whereby the rigid barrel provides the sole support for the coiled curtain thus reducing damage to the coiled curtain in the event the coiled curtain is struck by a vehicle.

6. The side coiling door as defined in claim 5 wherein said barrel is supported solely at its upper end thereby eliminating any connection between a lower portion of the opening and the barrel.

7. The side coiling door as defined in claim 5 further including spring means exerting resilient torque on said rotatable barrel to maintain tension on the flexible curtain at all positions thereof and when being wound onto or unwound from the barrel.

8. The side coiling door as defined in claim 7 wherein said means exerting resilient torque on the barrel includes a support shaft on which the barrel is rotatably supported, a coil spring encircling the shaft with one end attached to the shaft and the other end attached to the barrel, said barrel being driven to maintain substantially a constant resilient torque transmitting relationship between the shaft and barrel to maintain a constant spring tension on the flexible curtain to retain the flexible curtain on the short barrel when winding and unwinding in relation thereto.

9. A side coiling door as claimed in claim 1 wherein said first means comprises a flexible plastic tape slidingly interengaged with said track means to support the curtain during movement between opening and closed positions.

10. The side coiling door as defined in claim 9 wherein said plastic tape is of hat shaped transverse configuration with top and bottom flanges received in said track means, said track means including a laterally opening channel shaped member receiving the top and bottom flanges of said hat shaped plastic tape to slidingly support the flexible curtain from the track means.

11. A side coiling flexible door for an opening comprising a vertically disposed flexible curtain, means supporting an upper edge portion of said curtain for movement between open and closed positions, and means adjacent at least one side edge of the opening for coiling the curtain into a coil when the curtain is moved to open position and uncoiling the curtain when moved to closed position, said coiling and uncoiling means including a generally cylindrical rigid barrel supported for rotation about a generally vertical axis, means on the periphery, of the barrel for interlocking supporting engagement with the upper edge portion of a first convolution of said curtain when wound onto the barrel, and means on the upper edge portion of the curtain for interlocking supporting engagement between all other convolutions of the curtain wound on the barrel when the curtain is in open position.

12. The side coiling door as defined in claim 11 wherein said means on the upper edge portion of the curtain to support the door from the track means and barrel includes a continuous plastic tape of hat shaped configuration and provided with a central portion defining a laterally opening groove and upper and lower offset flanges, said track means including a channel shaped trackway receiving said flanges, the upper edge portion of said curtain including a continuous projection on the surface opposite to the groove whereby the groove and projection interlock when the curtain is wound on the barrel.

13. The side coiling door of claim 12 wherein said barrel includes a single convolution of said tape anchored thereto with the groove facing outwardly to receive the projection on the first convolution of the flexible curtain when wound onto the barrel.

14. The side coiling door of claim 11 further including a spring means exerting resilient torque on said rotatable barrel to maintain tension on the flexible curtain at all positions thereof and when being wound onto or unwound from the barrel.

15. A side coiling door for an opening comprising a vertically disposed flexible curtain, support means including a track extending across the upper portions of the opening to support the curtain for movement between open and closed positions, means at one edge of the opening for coiling and uncoiling said curtain, said means for coiling the flexible curtain including a cable assembly including a cable drum and a vertically short cylindrical barrel of substantially the same diameter, said barrel being connected to said drum, a cable engaged with the cable drum and having end portions connected with a free edge of said curtain for moving the free edge of the curtain in relation to the support means and winding the curtain onto the barrel and unwinding the curtain from the barrel, drive means connected with said cable for linear movement of the cable, movement of the free edge of the curtain, and rotation of the cable drum and barrel, wherein said flexible curtain includes a plastic tape attached to the curtain and interengaged with the barrel and said track to support the curtain during movement, said plastic tape being oriented along the top edge of the flexible curtain and including a groove in one surface thereof, a continuous projection on the opposite surface of the upper edge, of the flexible curtain thereby interlocking the convolutions of the flexible curtain that are spirally wound on said barrel.

16. The side coiling door as defined in claim 15 further comprising tension spring means interconnecting the cable drum and barrel to maintain a substantially constant spring tension on the barrel as the flexible curtain winds onto and unwinds from the barrel.

17. The side coiling door as defined in claim 16 wherein said spring means includes an elongated generally cylindrical coil spring, said barrel and cable drum being supported from a single shaft with the cable drum being keyed thereto, said spring being telescoped over a portion of the shaft and having one end anchored thereto, the other end of said spring being connected to said barrel, said barrel being rotatably supported by said shaft whereby the spring transmits resilient torque between the shaft and barrel.

18. The side coiling door as defined in claim 17 wherein said cable has ends anchored to the free edge of the curtain in a manner to enable the coil spring to be pretensioned by rotating the barrel a predetermined number of revolutions while holding the cable drum stationary with the pretensioned characteristics of the spring remaining substantially constant during winding and unwinding of the curtain in relation to the barrel.

19. A side coiling flexible door as claimed in claim 11 wherein the lower end of said curtain includes a hem, a flexible member mounted in said hem to retain the curtain vertically taut to resist wind or air pressure billowing the curtain.

20. The side coiling door as defined in claim 19 wherein a tubular bottom track is recessed into a floor surface with the track including an upwardly opening slot receiving said hem therethrough with the track forming a guide for movement of the hem when the curtain is moved between open and closed positions, the leading edge of said curtain including oppositely disposed wheels at the lower corner thereof received in said track to facilitate opening and closing movement of the curtain.

* * * * *